US006256911B1

(12) United States Patent
Duarte Vieira

(10) Patent No.: US 6,256,911 B1
(45) Date of Patent: Jul. 10, 2001

(54) ADVERTISING DEVICE FOR BEVERAGES WITH BUBBLING LUMINOUS ANIMATION

(76) Inventor: Francisco Jose Duarte Vieira, Rua Uba, 351/101, Floresta, CEP-31110-110, Belo Horizonte, MG Brazil, Belo Horizonte (BR)

( * ) Notice: Subject to any disclaimer, the term of this patent is extended or adjusted under 35 U.S.C. 154(b) by 0 days.

(21) Appl. No.: 09/214,843

(22) PCT Filed: May 19, 1997

(86) PCT No.: PCT/BR97/00019

§ 371 Date: Jan. 14, 2000

§ 102(e) Date: Jan. 14, 2000

(87) PCT Pub. No.: WO97/44772

PCT Pub. Date: Nov. 27, 1997

(30) Foreign Application Priority Data

May 20, 1996 (BR) ..... 9602442

(51) Int. Cl.[7] ..... G09F 19/00
(52) U.S. Cl. ..... 40/406; 40/441; 40/540
(58) Field of Search ..... 40/406, 409, 412, 40/439, 441, 540, 564, 902; 446/267; 472/65

(56) References Cited

U.S. PATENT DOCUMENTS

| | | | | |
|---|---|---|---|---|
| 1,895,773 | * | 1/1933 | Schepmoes | 40/540 |
| 2,667,001 | * | 1/1954 | Sheridan | 40/406 |
| 2,795,068 | * | 6/1957 | Standard | 40/441 |
| 3,120,068 | * | 2/1964 | Winther | 40/540 X |
| 4,208,848 | | 6/1980 | Kohl | 40/406 X |
| 5,106,660 | * | 4/1992 | Vorel | 40/412 X |
| 5,349,771 | | 9/1994 | Burnett | 40/406 |
| 5,819,452 | * | 10/1998 | Hakkert | 40/406 |

FOREIGN PATENT DOCUMENTS

| | | | |
|---|---|---|---|
| 2 651 598 | | 3/1991 | (FR) . |
| 2040531 | * | 8/1980 | (GB) ..... 40/406 |
| WO 95/10 105 A1 | | 4/1995 | (WO) . |

* cited by examiner

*Primary Examiner*—Brian K. Green
(74) *Attorney, Agent, or Firm*—Dickinson Wright PLLC

(57) ABSTRACT

The present device relates to an advertising device which simulates the bubbling formed in a glass container containing a sparkling beverage. The device comprises a transparent container in the shape of a glass with a lid thereon, the container having a hydro-alcoholic solution in the color of the product to be advertised. To create the bubbles, a closed circuit inert gas system (such as nitrogen) having a compressor, a check valve and a cyclone separator for separating the gas from an entrapped liquid is provided. The system has a first tube with a bubblier attached thereto for injecting micro-bubbles into the container, a second tube for capturing the inert gas at the surface of the liquid in the container, and a third tube for returning the liquid sprayed by the gas back into the container liquid. A panel is preferably provided on which the container is positioned, wherein a back-lighting device and intermittent lights that flash at a rate controlled by a timer can be provided to illuminate the device. The timer preferably controls the compressor so that the input of micro-bubbles into the container, and the operation of the lights, can be synchronized.

20 Claims, 3 Drawing Sheets

ADVERTISING DEVICE FOR BEVERAGES WITH BUBBLING LUMINOUS ANIMATION

FIELD OF THE INVENTION

The present disclosure refers to an advertisement device for beverages whose purpose is to stimulate the consumption of such products by means of the constant or intermittent illumination and bubbling of the liquid contained within a container, through the formation of clouds of micro bubbles and a superficial layer of froth.

BACKGROUND OF THE INVENTION

In the present state of the art, the sales of mass consumption products such as beer, colas and drinks relies on the use of efficient media of advertisement in the points of sale. This is the result of the great variety of brands and products available in the market and of the fierce competition between them all.

To this effect, the consumer is at all times subjected to a great variety of promotional devices of all sorts such as posters, calendars, watches, caps, key-holders, prizes, and gifts, whose aim is to attract his attention and to imprint the brand in his brain. However, the market is already saturated by this type of merchandising and the competition ends up resulting in apathy and disinterest of the public.

SUMMARY OF THE INVENTION

The present invention is based in a novel concept of merchandising such products by means of an unusual motion effect intended to call the attention of the potential consumer. It consists of a medium of advertisement that stimulates the sales and the consumption of beverages by inducing the desire for them as the result of the vision of the liquid in motion and the formation of a layer of foam at the surface and the condensation. of humidity in the exterior, just as happens during actual conditions.

The present advertisement device consists of a cup, a bottle or a flask which is mounted inside a panel molded in with the shape of the desired container, which is illuminated from behind and filled with a liquid that imitates the desired beverage (beer, cola, or such). The liquid is "brought to life"—that is, caused to bubble as in its state during actual consumption—in order to cause an irresistible desire to drink in the prospective consumer.

The device in question is a closed circuit of an inert gas (usually nitrogen) formed by a compressor, a bubblier, a catcher of sprayed liquid and a check valve that prevents the countercurrent of the liquid. The said circuit encloses a certain amount of liquid usually consisting of an alcoholic solution colored like the product to be advertised.

In this circuit the gas is driven—in the intermittent cycles dictated by a timer that turns the compressor on and off—up to the surface of the liquid, which is contained in a container such as a glass, a bottle or a flask attached to the panel or molded on it. Micro-bubbles are formed inside the liquid by means of a bubblier in the end of the tube that leads the gas to the bottom of the container. Once inside the liquid, the micro bubbles rise and bubble to the surface and form a new layer of foam at each cycle, but never exceed a predetermined level. When they reach the surface, the bubbles burst and release the gas which is recaptured by means of a catching tube placed near the surface of the liquid and is led to a cyclone separator that separates the gas from the liquid. In this way the gas is returned to the compressor in dried condition, whereas the sprayed liquid is returned to the container.

In the compressor the dry gas is impelled back into the liquid after passing through the check valve that prevents the return of the liquid when the compressor is turned off at the end of a cycle. An inert gas such as nitrogen ($N_2$) is used in the circuit, so as to allow a long useful life for the device. The liquid consists of an alcoholic solution colored with the color of the product to be advertised and which allow the formation of micro-bubbles in a proportion and size similar to the one desired.

BRIEF DESCRIPTION OF THE DRAWINGS

The figures that illustrate the present text include numerical references to be used in conjunction with the detailed description below, which is a possible embodiment of the invention, but is in no way restricted to its size, proportions, materials, shapes or finishes eventually chosen for its industrialization, but are only illustrative and intended to help the understanding of its constructive details.

DETAILED DESCRIPTION OF THE INVENTION

Figure 1:
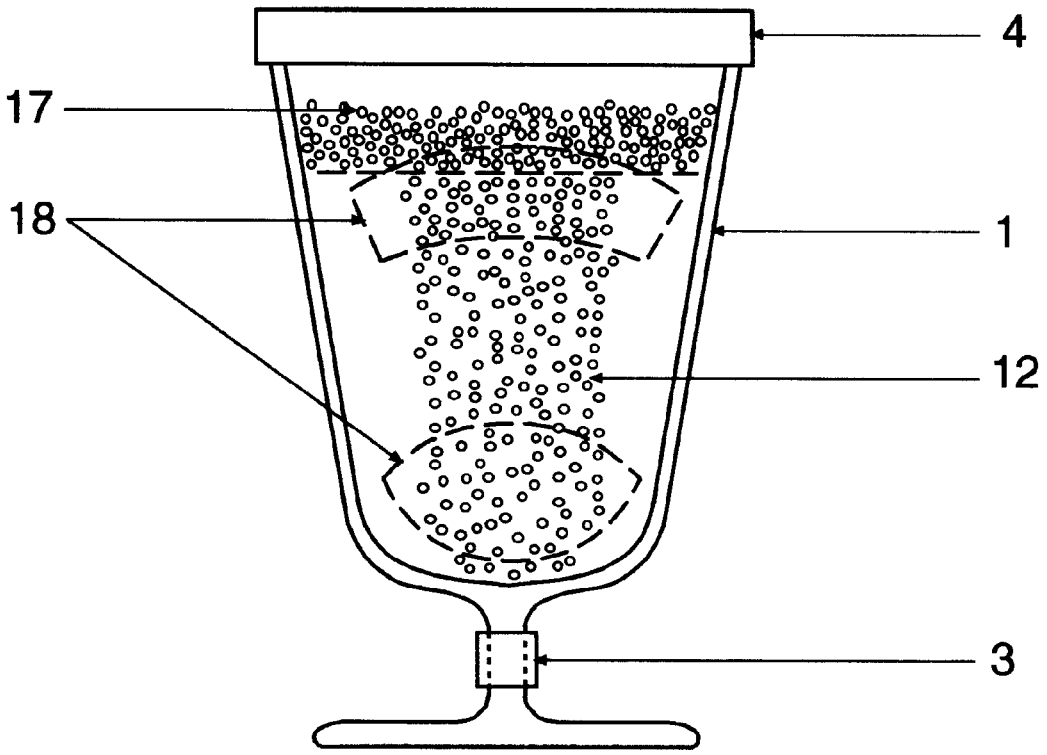
FIG. 1 is a front view of the transparent container of the present invention.
Figure 2:
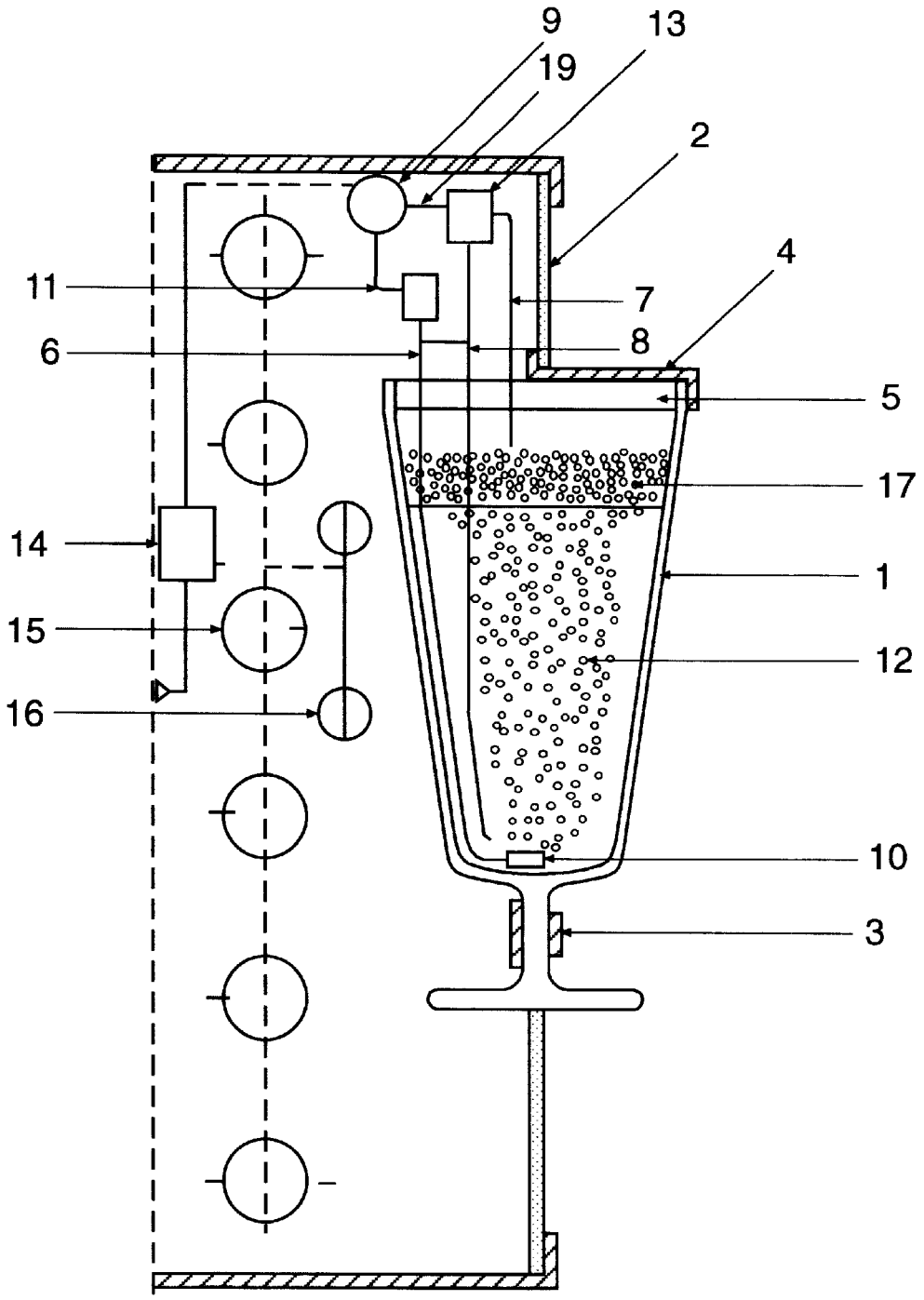
FIG. 2 is a side view displaying the constructive details of the gas circuit and its components.
Figure 3:
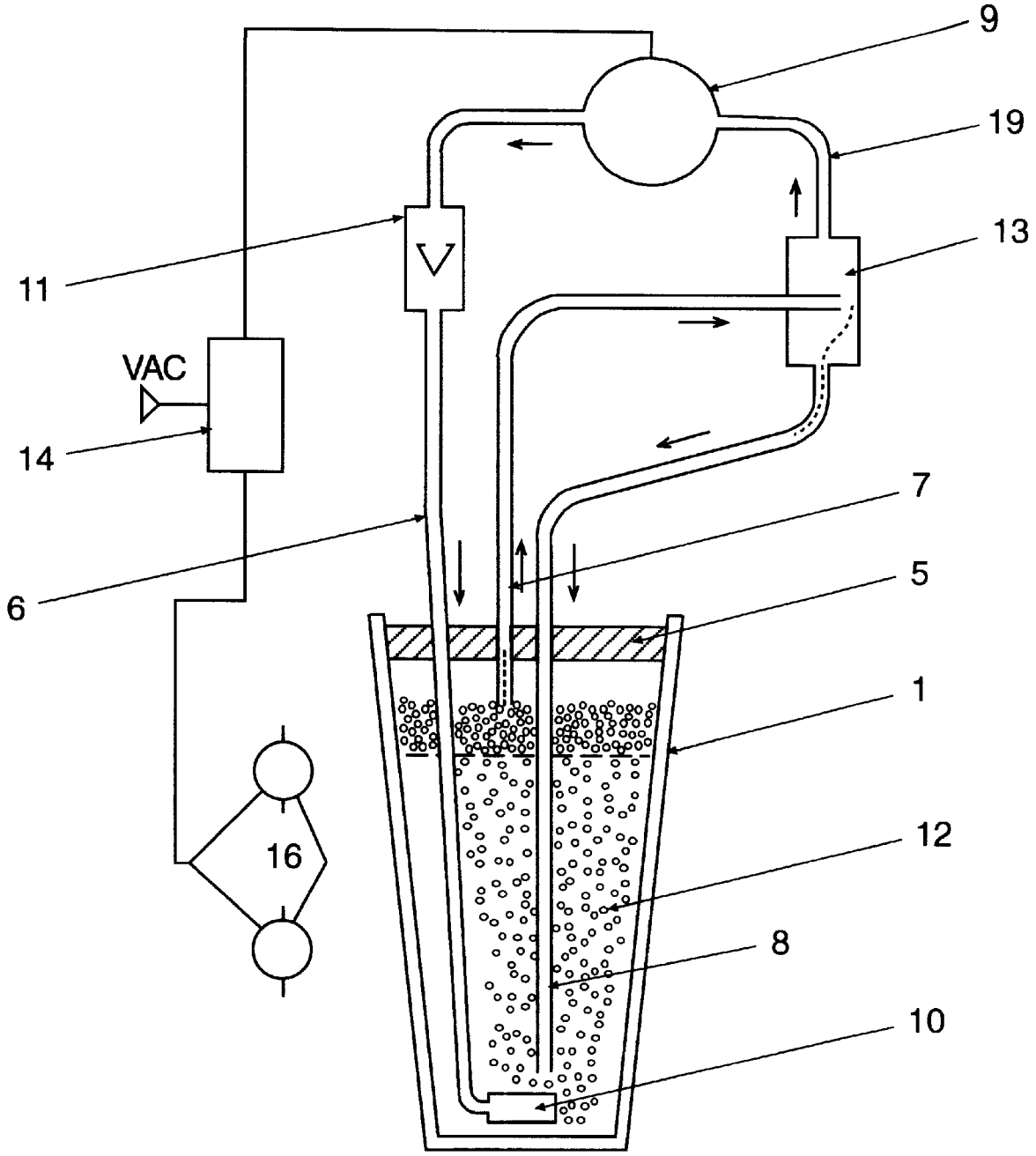
FIG. 3 is a schematic diagram showing the details of the circuit and its components, as well as the way in which they act inside the container of the liquid.

The present invention, in the embodiment illustrated in the figures in question, consists of an advertisement device composed of a container such as a glass, cup, bottle or flask of 40 transparent material (1) which is integrally molded to a panel of translucent material (2) or, yet, attached to it by means of clamps (3) and a fixation ring (4).

Said container (1) contains a certain amount of an alcoholic solution artificially colored in the color of the advertised product, 45 and has a lid (5) and tubes (6; 7 and 8), said tubes being, one of them (6) for admitting the inert gas (nitrogen) into the liquid, the second (7) for the capture of the released gas from the bubbles and the third (8) for returning the sprayed liquid dragged by the gas back to the surface of the liquid. A fourth tube (19) is used to transfer gas separated from the solution by the separator back to the compressor.

Said tubes (7, 8, and 19) form a closed circuit for the gas which is impelled by means of a compressor (9) into a bubblier (10) attached to the lower extremity after passing through a check valve (11) that prevents the counter-current of the liquid when the device is turned off. The micro-bubbles form and rise to the surface of the liquid, where they burst open. These micro-bubbles form a layer of froth and then liberate the enclosed gas that is recaptured by the intended tube (7) at a rate dependent of the speed of compression dictated by the compressor (9). The liberated gas is admitted into a cyclone separator (13) that separates the gas from the liquid dragged by it from the surface of the liquid. Said cyclone separator returns the collected liquid back to the container by means of a tube (8), whereas the dry gas is returned to the compressor (9), via the fourth tube (19) closing the circuit. A new cycle is started every time the timer (14) turns the compressor (9) on and off.

The panel is back-lit by a back-lighting device (15) and a set of intermittent lights (16) which flash in order to enhance the effect of bubbling of the micro-bubbles (12) which condense at the surface of the liquid, where they form a layer of froth (17) which imitate their natural formation, but are prevented from building up too much, in order to attract the attention of the watcher. At the external surface of the container are placed adhesives (18) printed with the brand of the product and which must be adequate to the desired visual effect and to the particular product, in order to stimulate its consumption.

According to these characteristics and to the embodiment just described, the result is a medium of publicity which incorporates animation, light and bubbling and which is so novel and original that it has all the requirements to deserve a utility patent.

What is claimed is:

1. An advertising device comprising:

a container made at least in part of transparent material;

a lid attached to said container;

a hydro-alcoholic solution placed in said container, said container having tubes and forming a closed circuit containing an inert gas and having a compressor, a check valve and a cyclone separator;

wherein a first of said tubes is provided for the admittance of said gas at the bottom of said container, said first tube having a bubblier coupled thereto for the formation of micro-bubbles with said gas;

wherein a second of said tubes is provided for the capture of said gas from said micro-bubbles at the surface of said solution in said container and the transfer thereof to the cyclone separator for separating the gas from the solution;

wherein a third of said tubes is provided for returning the captured solution separated from said gas back into said solution in said container; and wherein a fourth of said tubes is provided for transferring the gas separated from said solution by the separator to the compressor.

2. The advertising device according to claim 1, wherein said gas is impelled by said compressor down to the bottom of said first tube where said bubblier forms said micro-bubbles which rise to the surface of said solution where they form a layer of froth.

3. The advertising device according to claim 1, wherein said inert gas in said closed circuit is activated by means of a timer that can be programmed to turn the compressor on and off.

4. The advertising device according to claim 3, wherein said closed circuit can be activated intermittently or continuously by means of said timer.

5. The advertising device according to claims 4, wherein a back-lighting device and intermittent lights that flash at a rate controlled by said timer are provided to illuminate said device.

6. The advertising device according to claim 5, wherein said timer is adapted to synchronize the operation of said compressor and the operation of said intermittent lights.

7. The advertising device according to claim 3, wherein said timer can be used to regulate the output of said micro-bubbles by said compressor.

8. The advertising device according to claim 1, wherein the container is imprinted with advertisement stickers.

9. The advertising device according to claim 1, wherein a translucent panel is provided on which said container is positioned.

10. The advertising device according to claim 5, wherein said container is mounted on said panel by means of clamps and a retaining ring.

11. The advertising device according to claim 5, wherein a back-lighting device and intermittent lights that flash at a rate controlled by a timer are provided behind said panel to illuminate said device.

12. The advertising device according to claim 1, wherein said check valve is adapted to prevent the solution in said container from flowing into said compressor.

13. The advertising device according to claim 1, wherein said separator is adapted to separate the solution from the inert gas drawn through the second tube from the surface of said solution.

14. The advertising device according to claim 1, wherein the inert gas is nitrogen.

15. The advertising device of claim 1, wherein said hydro-alcoholic solution is dyed a predetermined color that matches a color of an existing product.

16. The advertising device of claim 1, wherein said cyclone separator is adapted to separate said gas from an entrapped liquid.

17. The advertising device of claim 1, wherein said first tube has a tip upon which said bubblier is coupled.

18. An advertising device comprising:

a container having a transparent body portion;

a lid attached to said container;

a predetermined amount of fluid in said container; and a closed circuit inert gas system having, a compressor, a check valve and a cyclone separator for separating gas from an entrapped liquid, wherein said system has a first tube with a bubblier attached for injecting micro-bubbles into said container, a second tube for capturing said gas from said micro-bubbles at a surface of said fluid in said container and drawing said gas into said separator, a third tube for returning the fluid sprayed by said gas and separated from the micro-bubbles back to the fluid in said container, and a fourth tube for transferring the gas separated from the micro-bubbles back to said compressor.

19. The advertising device of claim 18, wherein a panel is provided on which said container is positioned, and wherein a back-lighting device and intermittent lights that flash at a rate controlled by a timer are provided to illuminate said device.

20. The advertising device of claim 19, wherein said timer controls the compressor so that the input of micro-bubbles into said container, and the operation of said intermittent lights, can be synchronized.

* * * * *